United States Patent [19]

DeLine et al.

[11] 3,949,692

[45] Apr. 13, 1976

[54] CONTAINER LID AND METHOD OF MANUFACTURE

[75] Inventors: John W. DeLine, Denver; Nobel N. Ida, Boulder, both of Colo.

[73] Assignee: Entech Corporation, Denver, Colo.

[22] Filed: Feb. 25, 1974

[21] Appl. No.: 445,608

Related U.S. Application Data

[62] Division of Ser. No. 241,642, April 6, 1972, Pat. No. 3,794,206.

[52] U.S. Cl. ..... 113/121 C

[51] Int. Cl.[2] ..... B21D 51/38

[58] Field of Search ..... 113/121 C

[56] References Cited

UNITED STATES PATENTS

| | | | |
|---|---|---|---|
| 3,334,775 | 8/1967 | Klein et al. | 220/48 |
| 3,525,455 | 8/1970 | Saunders | 113/121 C |
| 3,696,961 | 10/1972 | Holk, Jr. | 220/54 |
| 3,705,563 | 12/1972 | Elser | 113/121 C |
| 3,765,352 | 10/1973 | Schubert et al. | 113/121 C |

*Primary Examiner*—Milton S. Mehr

*Attorney, Agent, or Firm*—Reilly and Hancock

[57] ABSTRACT

A container lid for beverage containers and the like has a tear strip formed as a unitary part of the closure which can be at least partially separated from the closure by pressing it downwardly to displace it into the container about a hinge point in such a way as to leave a protected opening for removal of the contents from the container.

5 Claims, 16 Drawing Figures

CONTAINER LID AND METHOD OF MANUFACTURE

This application is a divisional of Ser. No. 241,642, filed 4-6-72 now U.S. Pat. No. 3,794,206.

This invention relates to novel and improved container end closures, and more particularly relates to end closures and a method of making same having integral tear strips or sections which are relatively easy to open and when displaced inwardly to form an opening will nevertheless remain as a connected part of the container, said closures being specifically adaptable for use in connection with beverage containers.

In beverage containers, it is customary to form the container lid with an integrated opening device or tab defined by a scored or otherwise weakened line of separation which can be manually displaced to be opened so as to permit removal or drinking of the contents. Generally the tab is located near the outer periphery of the lid and may suitably be of elongated, oval or circular configuration and is provided with some type of stiffening portion around the periphery of the tab to assist in promoting fracture or shear of the tab along its weakened line of separation.

Previously, it has been proposed to form such opening devices or tabs as a tear strip in a depressed section beneath the surface of the lid with a surrounding edge forming a stiffening portion as well as a protective edge for drinking purposes. For example, reference is made to U.S. Pat. No. 3,334,775 to Klein et al and U.S. Pat. No. 2,312,358 to Punte. The present invention has to do with certain improvements in the manufacture of such lids wherein the tear strip is recessed within the lid as a unitary part thereof and cooperates with the lid in forming an effective end closure for a container but is readily displaceable inwardly under finger pressure to leave a protected opening for removal or drinking of the contents. It is particularly important that the formation of the weakened area be closely controlled to form the necessary seal but at the same time permit ease of fracturing or shearing without the risk of injury; and from an ecological standpoint it is desirable that the tear strip remain attached within the can once opened without interfering with removal of the contents from the can.

Accordingly, it is an object of the present invention to provide a novel and improved container of the type in which a unitary tear strip is displaceable from the lid into the container under finger pressure to form a protective opening for removal of the contents and which eliminates the necessity of scoring to form the area of separation between the lid and tear strip.

It is another object of the present invention to minimize the risk of injury to the fingers in opening or to the mouth in drinking the contents of the container.

It is a further object of the present invention to facilitate opening a container in which the contents are held under pressure by utilization of a container lid which is so constructed as to establish an effective seal against accidental leakage of the contents even under rough handling, is capable of withstanding extremely high internal pressure without leakage, but can be opened readily without the aid of mechanical opening devices for removal of the contents.

It is still a further object of the present invention to provide for a novel and improved method of forming container lids of the type having integrated tear strips wherein the method requires a minimum number of steps in formation and lends itself well to assembly line or mass production procedures while being highly dependable and efficient in use.

It is an additional object of the present invention to provide for a sheet metal container end closure of the type having a press-in tear strip recessed beneath the surface of the closure but formed integrally therewith and characterized by having a closely-controlled weakened area of separation formed by coining along the outer periphery of the tear strip beneath the lid surface and an improved stiffening rib to promote initial fracture of the tear strip from the closure.

In accordance with the present invention, improvements in container lids have been devised wherein the lids are specifically adapted for use in beverage containers, such as, beer cans. Specifically, the container lids are of the type having an integrally formed press-in tear strip in off-center relation to the lid and relatively near the periphery of the lid, the tear strip being encircled by a rolled drinking surface. Preferably the drinking surface is reverse-formed out of the thickness of the lid to curve downwardly and outwardly beneath the lid surface then is once again reversed in a direction to merge into a tear-open section or strip spaced beneath the lid surface.

The present invention has to do not only with improvements in the formation of the rolled drinking surface, but also with the reverse forming and folding of the encircling edge portion beneath the lid surface followed by coining a weakened area of separation between the encircling edge portion and the tear-open section. The area of separation is interrupted only to form a limited hinge point whereby to permit inward displacement of the tear strip about the hinge point under finger or thumb pressure so that the tear-open section will remain intact within the can and permit pouring or drinking of the contents through the opening. The protective encircling edge, in combination with the weakened area of separation, greatly minimizes possible injury to the finger or hand in opening the can or to the mouth in drinking from the can. This is accomplished by the particular construction and configuration of the rolled drinking surface as well as the placement and formation of the weakened area of separation beneath the lid surface and somewhat outside of the encircling edge so as not to be subject to accidental fracture or rupture under pressure of the contents of the can. Preferably the weakened area of separation formed beneath the encircling edge is done by a closely controlled coining operation around the outer periphery edge of the tear strip, directly following the reverse forming of the encircling edge to form an outwardly tapered area of separation. The coining step can be accompanied by a scoring step if desired as well as application of a sealant in the score line formed along or through the coined section to insure against leakage.

In the alternate forms of invention to be hereinafter described, most desirably inward displacement of the tear-open section is controlled so as to be initiated from a point nearest the outer peripheral edge of the lid preferably by extension of a raised rib radially across the intersection of the tear-open section or strip and encircling edge with the outer lid surface. The inner section of the rib with the rolled drinking surface and encircling edge, which also defines a stiffening portion serves to concentrate the application of pressure at that point along the weakened area of separation directly beneath the intersection of the rib with the encircling edge. This point of initial fracture or rupture of the weakened area is opposite to the hinge point formed in the weakened area so that the fracture of the tear strip will proceed inwardly toward the center of the lid thereby causing the tear-open section to be displaced downwardly and inwardly toward the center of the lid. The tear strip may assume various configurations, such as, generally circular or an oval-shaped configuration with a wider oval portion towards the outer periphery of the lid. Other stiffening portions may also be formed either in the surface of the tear-open section or lid section which will contribute to concentrate the pressure exerted at a desired piercing point along the weakened area of separation.

The above and other objects, advantages and features of the present invention will become more readily appreciated and understood from a consideration of the following detailed description of preferred and alternate forms of the present invention when taken together with the accompanying drawings, in which.

Figure 3:
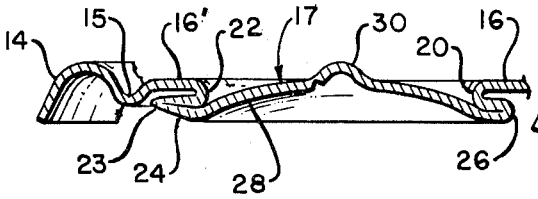
FIG. 3 is an enlarged cross-sectional view of the form of end closure shown in FIG. 1.
Figure 4:
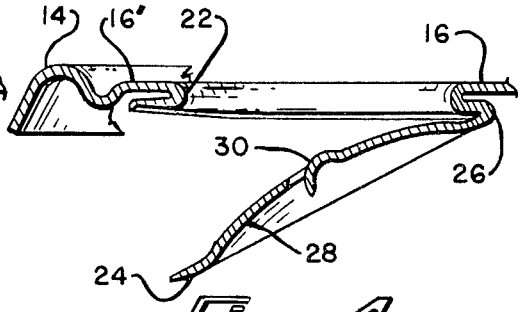
FIG. 4 is an enlarged cross-sectional view of the end closure of FIGS. 1 to 3 with the tear strip shown in an open position.
Figure 5:
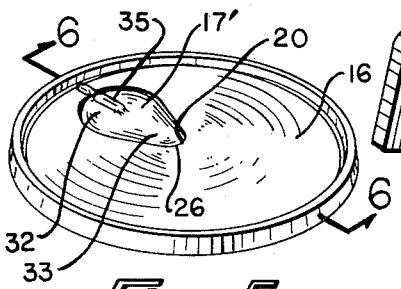
FIG. 5 is a somewhat perspective view of a modified form of end closure.
Figure 6:
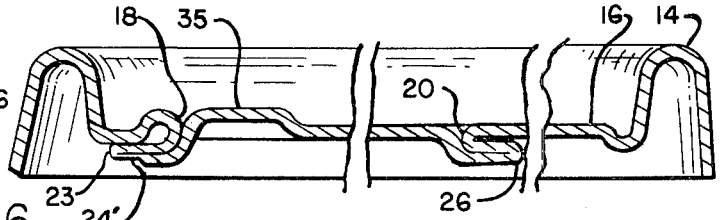
FIG. 6 is an enlarged cross-sectional view taken about lines 6—6 of FIG. 5.
Figure 10:
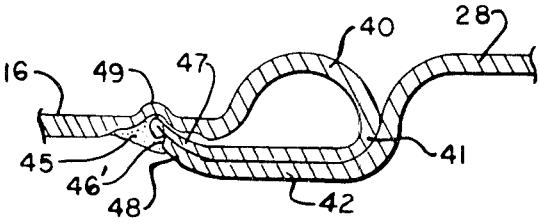

FIG. 10 is a cross-sectional view in detail of another modified form of end closure; and FIGS. 11 to 16 illustrate in cross-sectional form the sequence of steps followed in formation of a container lid of the type illustrated in FIGS. 1 to 4 together with the rolled drinking edge of FIGS. 5 and 6 wherein the lid is successively dimpled, squared, reverse-formed, drawn, flattened and coined into the desired configuration.

Figure 1:
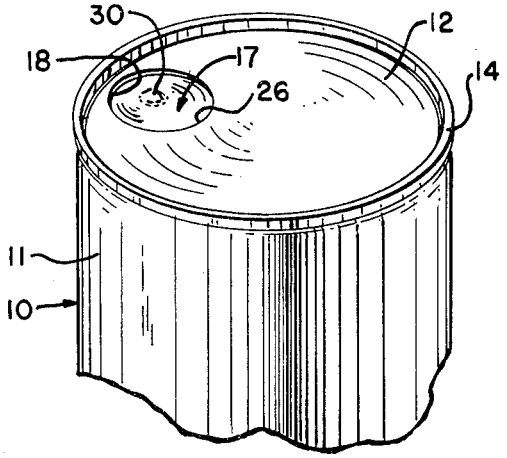
FIGS. 1 and 2 are somewhat fragmentary views in perspective of one form of container end closure, in accordance with the present invention, FIG. 1 illustrating the tear strip in the closed position and FIG. 2 illustrating the tear strip in the open position.
Figure 2:
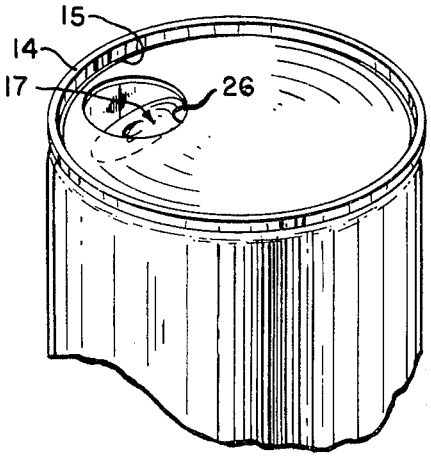

Referring in more detail to the drawings, there is shown by way of illustrative example in FIGS. 1 and 2 a beverage container 10, such as, a beer can having a cylindrical wall 11 and a generally circular container end closure 12. The end closure 12 is relatively thin and flat and is sealed in a conventional manner to the edge of the cylindrical wall 11 by an outer peripheral rim or seam 14 in a manner not shown. Also in accordance with conventional practice a slight groove 15 may extend circularly around the end closure or lid 12 just inwardly of the peripheral rim 14.

As shown in FIGS. 3 and 4, the end closure or lid 12 is of unitary construction and is seen to broadly comprise an outer, relatively flat lid section 16 and an inner tear-open section or strip 17 which is formed out of the material of the lid, in a manner to be described, so as to be recessed beneath the plane of the lid section 16. The tear-open section 16 is shown as being of generally circular configuration and is off-set from the center of the lid so that the outermost point 18 on its circumference is directly adjacent or contiguous to the outer peripheral rim 14, separated only by the groove 15 and a limited surface portion 16' of the lid section 16.

In the formation of the tear-open section, the lid section is provided with a protective, encircling edge 20 which surrounds the tear-open section 17, the edge portion 20 undergoing a first downward and outward reversal upon itself as designated at 22, followed by a second downward and inward reversal upon itself as designated at 23 to terminate beneath the surface of the lid where it continues into and is joined to the outer periphery 24 of the tear-open section 17. The reversed portion 23 of the edge 20 beneath the lid surface 16 is together with the outer peripheral end 24 of the tear-open section 17 flattened beneath the lid surface, and the peripheral edge 24 of the tear-open section is thinned or coined into an extremely thin, outwardly tapered section at that point to form a weakened area of separation between the tear-open section 17 and the encircling edge 20. The weakened area extends continuously around the peripheral edge of the section 17 except at a limited area 26 which is diametrically opposite to the outermost point 18 on the tear-open section where the flattened and coined sections are interrupted so as to form the hinge area 26 as shown in FIGS. 3 and 4. In general, the thickness of the lid is reduced in excess of one-half of its original thickness in the coining operation. For the purpose of illustration and not limitation, in a sheet metal or aluminum alloy container lid having a thickness of 0.012 inch the outer peripheral edge of the tear-open section may be reduced to a thickness on the order of 0.001 to 0.005 inch to form the weakened area of separation 24 beneath the surface of the lid section 16. This area 24 can be fractured under finger pressure to permit downward displacement of the tear-open section into the can about the hinge point 26, for example, to the position illustrated in FIG. 4. Accordingly, when the tear-open section is displaced downwardly by the finger or thumb, the encircling edge portion 20 will prevent direct contact with the fractured edge of the can along the area of separation and will also avoid contact with the area of separation by the mouth in drinking from the can.

In the form described, it will be seen that the width of the limited surface area 16 remaining between the encircling edge 20 and outer peripheral edge 14 of the lid is just sufficient to permit reverse forming and flattening of the reverse portion of the encircling edge beneath the lid surface. Moreover, it is desirable that the tear-open section 17 be given a slight convexity as shown at 28 so as to stiffen the section and concentrate the applied force along the weakened area of separation. In this relation, it will be seen that coining at the lower reversed or folded edge 24 will effect outward thinning or tapering of the upper and lower surfaces to a relatively sharp vertex, although the lower surface in the plane of the tear strip will undergo a greater reduction in thickness than the upper surface, so that separation will occur near or at the vertex formed at the tapered extremity of the lower edge 24. In addition, a vent area 30 may be formed in the tear-open section by suitably scoring or thinning to form a weakened line of separation 31 which is interrupted at 31' to provide a hinge. The vent opening 30 may be initially displaced under finger pressure to relieve pressure of the contents as a preliminary to displacement of the entire tear-open section. Alternately, in accordance with conventional practice, the vent opening 30 may be located in a separate portion of the lid section 16.

In the alternate form of invention shown in FIGS. 5 and 6, like parts and portions of the end closure are correspondingly enumerated to those of FIGS. 1 to 4. However, in the alternate form the configuration of the tear-open section is modified to be more nearly oval-shaped with a relatively wide, substantially semi-circular section 32 near the outer periphery of the lid extending into a relatively narrow, rounded triangular section 33 towards the center of the lid so that the tear strip is somewhat elongated with its major axis extending radially of the lid. Again the lid section has an encircling edge 20 in surrounding relation to the tear strip 17' which is reverse-formed and joined to the outer peripheral edge 24' of the tear strip in the same manner as described with reference to FIGS. 1 to 4. However, the edge 24 is coined by thinning into a stepped are directly beneath the fold of the lower reversal section 23. Another feature of the alternate form shown in FIGS. 5 and 6 is the provision for a rather highly crowned, stiffening rib portion 35 formed out of the thickness of the tear strip 17' and the encircling edge 20, which portion extends radially across and traverses the intersection of the tear strip 17', encircling edge 20 and lid surface at the outermost point 18 in diametrically opposed relation to the inner hinge point 26. It will be seen that the stiffening rib 35 is sharply crowned and half again as high as the raised or convex portion 30 of the tear strip thereby forming increased stiffening areas at the desired point of initial rupture or shear of the weakened area of separation 25. Accordingly, pressure applied to the stiffening rib 35 will be concentrated at the weakened area of separation 25 directly beneath the outermost point 18 and encourage initial shearing at that point. If desired, further weakening by scoring at least along the peripheral edge 18 will materially contribute to ease of initial separation at that point upon application of downward pressure to the tear strip.

Figure 7:
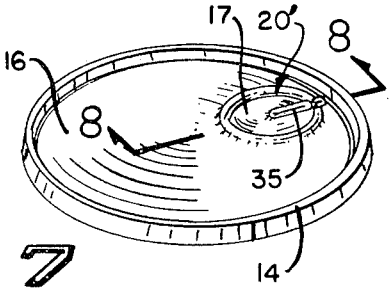
FIG. 7 is a somewhat perspective view of another form of end closure.
Figure 8:
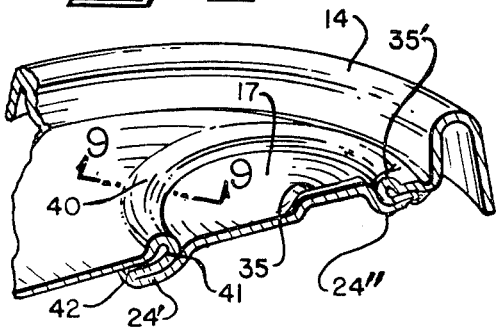
FIG. 8 is an enlarged cross-sectional view taken about lines 8—8 of FIG. 7.
Figure 9:
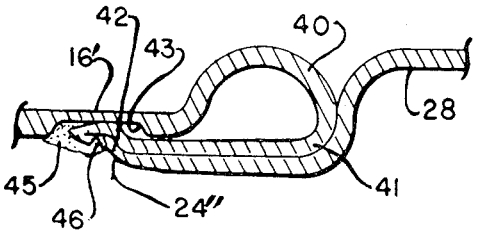
FIG. 9 is a cross-sectional view taken about lines 9—9 of FIG. 8.

Still another modified form is shown in FIGS. 7 to 9; and again like parts are correspondingly enumerated to those of FIGS. 1 to 4. In FIGS. 7 to 9 the tear strip 17 is of generally circular configuration and is off-set from the center of the lid so as to be relatively near the outer periphery of the lid as shown. In this form, the encircling edge portion 20' is raised above the surface of the lid 16 and specifically is curved rather sharply in an upward direction from the surface of the lid 16 to form a rolled drinking surface 40. As in the form of FIGS. 1 to 4, the edge portion then undergoes a downward and outward reversal 41 beneath the surface of the lid 16 followed by a second downward and inward reversal 42 into the outer peripheral edge 24'' of the tear strip 17, and a weakened area of separation again is formed at or contiguous to the edge 24'' by coining. As best seen in FIG. 9, however, the area 24'' is coined to the extent of thinning and compressing into an indented portion 43 in the undersurface of the lid just outwardly of the edge 20', and a suitable sealant 45 is applied along the coined area. A score line 46 is formed in the undersurface of the peripheral edge 24'' at the weakened area just inwardly of the fold of the reversal 42, except at the hinge area 26, and the sealant 45 is applied over the scored area to prevent accidental leakage prior to opening. By forming a relatively broad peripheral surface portion around the outer periphery of the tear strip which is flattened and tightly folded against the upper reverse folded portion of the encircling edge, with the weakened area of separation at the outer extremity, any danger of outward displacement of the tear-strip under the pressure of the fluid contents is substantially eliminated while permitting relative ease of inward displacement merely under hand or finger pressure.

In FIGS. 7 to 9, the stiffening rib 35 is formed out of the tear strip to extend radially across a limited portion of the tear strip adjacent to the outermost end point 18 and is aligned with a radial stiffening rib portion 35' formed out of the thickness of the lid so as to create additional stiffening at the desired point of initial rupture in the weakened area of separation directly beneath the point 18. The encircling edge portion 20' essentially defines a beaded edge portion which not only serves as a rolled drinking surface but lends additional stiffening to the lid in surrounding relation to the tear strip so as to cooperate with the stiffening rib 35 and afford increased ease of separation along the weakened area.

In still another modification illustrated in FIG. 10, the reverse folded portions 41 and 42 are coined by flattening, thinning and tightly folding upwardly along the areas 47 and 48 of the portions 41 and 42, respectively, into a depression of circular groove 49 in the lid section 16' between the outermost point of the lower portion 42 and the rolled drinking surface 40. Once again, the coined area may be scored as at 46' through the thickness of the coined portion 48 and covered by the sealant 45 as shown. An important feature of this form as well as that of FIGS. 7 to 9 is that coining, as a preliminary to scoring, will by weakening and thinning the area to be scored contribute greatly to the ease of scoring and as a result permit formation of the lid from metals other than special aluminum or steel alloy materials.

Figure 11:
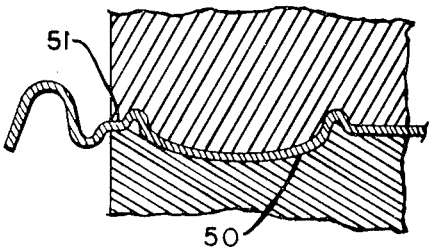
Figure 12:
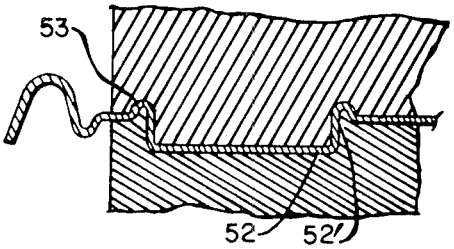
Figure 16:
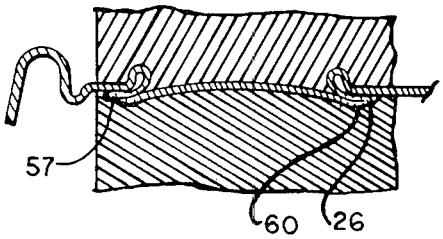

FIGS. 11 and 16 illustrate a preferred method for forming the invention similar to that illustrated in FIGS. 1 to 4 with a rolled drinking surface 40 as shown in FIGS. 7 to 9, except that the stiffening rib portions 35 and 35' are eliminated. In the sequence of operations to be described, the container lid 12 may be suitably formed out of a blank of metal commonly used in beverage containers, such as, a standard 5182 aluminum alloy which is currently used in the production of allaluminum beer containers. Hand tools, such as, suitable punch and die means as illustrated in performing the sequence of operations. In the initial step shown in FIG. 11, a blank of metal is depressed away from the original plane of the lid section 16 in a dimpling operation to form a generally concave or dished section 50. In FIG. 12, the depressed section 50 is deepened and squared to form a relatively flat bottom surface portion 52, a surrounding vertical wall section 52', and an upper rolled edge portion 53.

Figure 13:
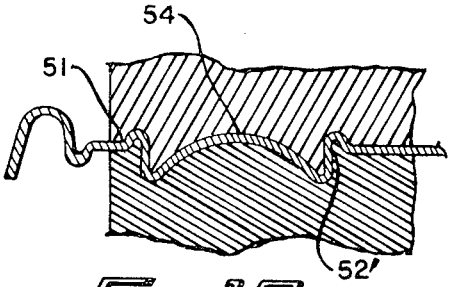
Figure 14:
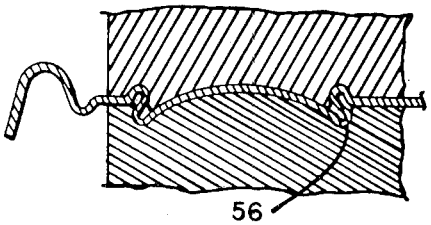
Figure 15:
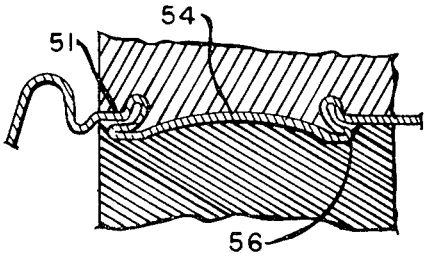

As illustrated in FIG. 13, in the next step the flat bottom surface 52 is reversed upwardly into a generally convex section 54 with its intermediate crown substantially on the same level as the original plane of the lid and with the outer edges folded upwardly into a generally W-shaped cross-sectional configuration with the outer surrounding vertical section 52'. In FIG. 14, the vertical section 52' and the outer folded edge of the intermediate section 52 are drawn outwardly, reverse formed and partially folded into the configuration illustrated, the folded section being designated 56. FIG. 15 illustrates further drawing and folding of the folded section 56 against the undersurface of the section 51 in the next successive operation.

Finally, as shown in FIG. 16, the folded section 56 at the outer peripheral edge of the intermediate section 54 is coined by further drawing and thinning of the metal to approximately one-half of its original thickness. As a result, the coined area, as designated at 57, defines a weakened area of separation around the outer periphery of the tear strip except at the hinge point 26. In addition, the hinge point is formed by a narrow groove 60 in the lower female die in the step shown in FIG. 16. Similarly, the stiffening rib section 35 may be formed out of the thickness of the material by mating rib and groove portions, not shown, formed in the punch and die sets in FIGS. 14 and 16; and most desirably the outer rib portion 35' would be formed in a corresponding manner in the outer section 51 in the initial stages of the forming operation as illustrated in FIGS. 11 to 13.

It will be appreciated from the foregoing that the various forms of invention illustrated and described afford a number of advantages and features in the formation of a container lid. The design itself is extremely simple lending itself well to mass production, and is readily conformable for use with a great variety of metals as well as some plastic materials. Moreover, the tear strip is recessed and protected from accidental fracture but when displaced inwardly about the hinge point 23' will remain intact with the can. The necessity of scoring and sealing is eliminated although they may be utilized in cooperation with the coining operation with beneficial results as described. The entire lid structure is unitary and may be formed out of a single blank of material; also the rolled surface formed around the encircling edge serves a dual purpose of preventing injuries in opening and acts as a stiffening portion in opening to promote increased ease of shearing along the weakened area of separation beneath the encircling edge.

It is therefore to be understood from the foregoing that various modifications and changes may be resorted to both in the method and articles produced according to the present invention without departing from the spirit and scope thereof as defined by the appended claims.

We claim:

1. The method of forming a tear strip in a container lid which comprises the steps of:

depressing a section of a blank of metal away from its original plane to form a lid with a depressed section therein;

reversing the outer surrounding edge between the lid and the depressed section whereby the lower terminal end of the reversed edge extends outwardly, substantially parallel to and beneath the surface of the lid; and thereafter coining the outer peripheral edge of the depressed section beneath the lid to reduce its cross-sectional thickness and form a weakened area of separation between the lid and the depressed section whereby the depressed section defines a tear strip.

2. The method of forming a tear strip in a container lid according to claim 1 further characterized by rolling the surrounding edge first upwardly above the surface of the lid then downwardly and outwardly beneath the lid surface.

3. The method according to claim 1 in which the weakened area of separation formed is scored through the coined area along the outer peripheral edge of the tear strip.

4. The method according to claim 3 in which the weakened area of separation is scored completely through its thickness and a temporary sealing composition is applied to the scored area.

5. The method according to claim 1 including the step of forming a raised stiffening rib out of the thickness of the lid and tear strip in a radial direction across the intersection of the lid and tear strip.

* * * * *